US011707133B2

(12) United States Patent
Duggins et al.

(10) Patent No.: US 11,707,133 B2
(45) Date of Patent: Jul. 25, 2023

(54) SHELF SUPPORT WITH CENTERING FEATURE

(71) Applicant: Tenn-Tex Plastics, Inc., Colfax, NC (US)

(72) Inventors: William Duggins, Kernersville, NC (US); Thomas R. Marsh, Wallburg, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 23 days.

(21) Appl. No.: 17/393,447

(22) Filed: Aug. 4, 2021

(65) Prior Publication Data

US 2022/0079342 A1 Mar. 17, 2022

Related U.S. Application Data

(60) Provisional application No. 63/078,578, filed on Sep. 15, 2020.

(51) Int. Cl.

| | |
|---|---|
| ***A47B 96/00*** | (2006.01) |
| ***A47B 96/06*** | (2006.01) |
| ***A47B 57/48*** | (2006.01) |

(52) U.S. Cl.

CPC ..... *A47B 96/068* (2013.01); *A47B 57/485* (2013.01); *A47B 96/061* (2013.01); *A47B 2220/0041* (2013.01)

(58) Field of Classification Search

None

See application file for complete search history.

(56) References Cited

U.S. PATENT DOCUMENTS

| | | | | |
|---|---|---|---|---|
| 3,471,112 | A * | 10/1969 | Macdonald | A47B 96/063 248/250 |
| 4,037,813 | A | 7/1977 | Loui et al. | |
| 4,053,132 | A | 10/1977 | Del | |
| 4,432,523 | A | 2/1984 | Follows | |
| 4,666,117 | A | 5/1987 | Taft | |
| 4,732,358 | A * | 3/1988 | Hughes | A47B 96/068 211/90.01 |
| 4,856,746 | A * | 8/1989 | Wrobel | A47B 96/068 108/107 |
| 5,080,311 | A * | 1/1992 | Engstrom | A47B 96/063 248/250 |
| 5,195,708 | A * | 3/1993 | Marsh | A47B 96/068 211/90.01 |
| 6,186,456 | B1 * | 2/2001 | Marsh | A47B 96/022 248/250 |
| 6,464,186 | B1 * | 10/2002 | Marsh | A47B 96/022 248/250 |
| 6,554,236 | B2 | 4/2003 | Marsh | |
| 2007/0090243 | A1 * | 4/2007 | Downing | A47B 96/068 248/235 |

* cited by examiner

*Primary Examiner* — Steven M Marsh

(74) *Attorney, Agent, or Firm* — Myers Bigel, P.A.

(57) ABSTRACT

A shelf support includes: a generally planar main body with front and rear faces, the main body further having upper and lower openings with a cross-beam therebetween; a support flange extending generally perpendicularly from the front face; a mounting dowel extending generally perpendicularly from the rear face; a capturing finger mounted at an upper edge of the upper opening, the capturing finger extending forwardly and downwardly at a first oblique angle to the front face; and a centering finger extending forwardly and downwardly from the cross-beam at a second oblique angle to the front face.

21 Claims, 3 Drawing Sheets

SHELF SUPPORT WITH CENTERING FEATURE

RELATED APPLICATION

The present application claims priority from and the benefit of U.S. Provisional Patent Application No. 63/078,578, filed Sep. 15, 2020, the disclosure of which is hereby incorporated herein by reference in full.

FIELD OF THE INVENTION

The present invention concerns shelf supports of the type used to support shelves between oppositely facing upright members such as cabinet side walls. The invention particularly relates to a shelf support that includes a locking mechanism to retain the shelf in place during movement of the cabinet or bookcase in which it is contained, or in case of jostling of the shelf during cleaning or manipulation of articles thereon.

BACKGROUND OF THE INVENTION

Brackets for supporting shelves inside cabinets, bookcases, and the like, while at the same time permitting the shelves to be readily adjustable, have been known for some time. However, the shipping of cabinets with internal shelves presents a problem. With shelf supports that do not also positively retain or lock the shelf in place, the jostling or shock that the article of furniture receives during shipping and handling can cause the shelf to bounce around within the cabinet and damage the cabinet. Thus, shelf supports having a retaining mechanism to maintain the shelf in position during movement have been proposed. Examples are shown in U.S. Pat. No. 4,666,117 to Taft; U.S. Pat. No. 4,432,523 to Follows; and U.S. Pat. No. 4,053,132 to Del Pozzo.

Even when cabinets are not shipped with shelves installed in place, it is extremely desirable to lock the shelves in place within the cabinets to prevent jostling of the shelves and the shelves from consequently falling down between the supports, and damaging the contents of any shelf positioned beneath that shelf. Thus, it is much more desirable to provide a cabinet or bookcase with an adjustable shelf that has the rigid and solid feel of a permanently installed shelf.

U.S. Pat. No. 3,471,112 to MacDonald et al. discloses a shelf support in which a resilient finger locks the shelf in place. The MacDonald device serves to reduce or prevent vertical movement of the shelf once it is installed in place. However, a problem with the MacDonald device is that no means is provided for resiliently retaining the shelf against lateral movement if the shelf is not precisely dimensioned to fit within the intended space. As will be appreciated, it is difficult to cut wood shelves to precise width dimensions so that all lateral movement of the shelf is avoided. Hence, the width of the shelves installed in a typical bookcase can vary around a median width, with some shelves being relatively long and other shelves being relatively short. Since shelves that are too wide must necessarily be trimmed to a shorter width or they will not fit into the provided space at all, the result can be shelves that rattle significantly within the cabinet of some means for cushioning lateral movement is not provided.

U.S. Pat. No. 4,037,813 to Loui et al, discloses a shelf support in which a shelf is passed over resilient members that carry a locking shoulder. The locking shoulder serves to reduce or prevent vertical movement of the shelf once it is installed in place, and the resilient members serve to tension the shelf against lateral movement. Thus, some variability of width of the shelf installed in place can be accommodated. However, this goal is frustrated in part by the need to force the shelf over the shoulder, which is formed from a solid piece that is angular in cross-section. As will be immediately apparent from FIGS. 3 and 4 of Loui, a shallower shoulder is required when a relatively long shelf is inserted, or the shelf will not be able to pass over the shoulder. However, a shallow shoulder will not effectively retain a shelf in place against jostling or the like, particularly on those occasions when a relatively short shelf is inserted in place. Another variety of a shelf support is discussed in U.S. Pat. Nos. 6,464,186 and 6,554,236 to Marsh, the disclosures of which are hereby incorporated herein by reference in full.

Accordingly, there is a need in the art for locking shelf supports that are able to securely lock shelve in place, which can accommodate the usual variability of shelf length, and do not rely upon precise lengthwise cutting of the shelves to be installed.

SUMMARY OF THE INVENTION

As a first aspect, embodiments of the invention are directed to a shelf support, comprising: a generally planar main body with front and rear faces, the main body further having upper and lower openings with a cross-beam therebetween; a support flange extending generally perpendicularly from the front face; a mounting dowel extending generally perpendicularly from the rear face; a capturing finger mounted at an upper edge of the upper opening, the capturing finger extending forwardly and downwardly at a first oblique angle to the front face; and a centering finger extending forwardly and downwardly from the cross-beam at a second oblique angle to the front face.

As a second aspect, embodiments of the invention are directed to a shelf support, comprising: a generally planar main body with front and rear faces, the main body further having upper and lower openings with a cross-beam therebetween; a support flange extending generally perpendicularly from the front face; a mounting dowel extending generally perpendicularly from the rear face; a capturing finger mounted at an upper edge of the upper opening, the capturing finger extending forwardly and downwardly at a first oblique angle to the front face, the first oblique angle being between about 10 and 20 degrees; and a centering finger extending forwardly and downwardly from the cross-beam at a second oblique angle to the front face, the second oblique angle being between about 10 and 20 degrees.

As a third aspect, embodiments of the invention are directed to a cabinet-shelf assembly, comprising: a cabinet having two opposed side walls; a generally horizontal shelf extending between the two side walls; and a shelf support mounted to each of the side walls to support the shelf. At least one of the shelf supports comprises: a generally planar main body with front and rear faces, the main body further having upper and lower openings with a cross-beam therebetween; a support flange extending generally perpendicularly from the front face and supporting the shelf; a mounting dowel extending generally perpendicularly from the rear face and mounted in a hole in the side wall of the cabinet; a capturing finger mounted at an upper edge of the upper opening, the finger extending forwardly and downwardly at a first oblique angle to the front face, a lower end of the capturing finger engaging an upper surface of the shelf; and a centering finger extending forwardly and downwardly from the cross-beam at a second oblique angle to the front face, the centering finger engaging a side edge of the shelf.

DETAILED DESCRIPTION

Figure 2:
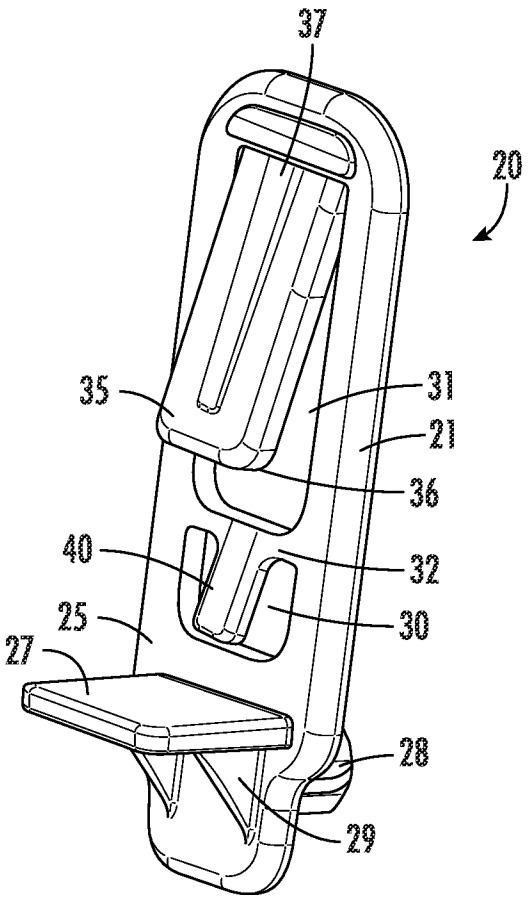
FIG. 2 is a front perspective view of the shelf support of FIG. 1.
Figure 1:
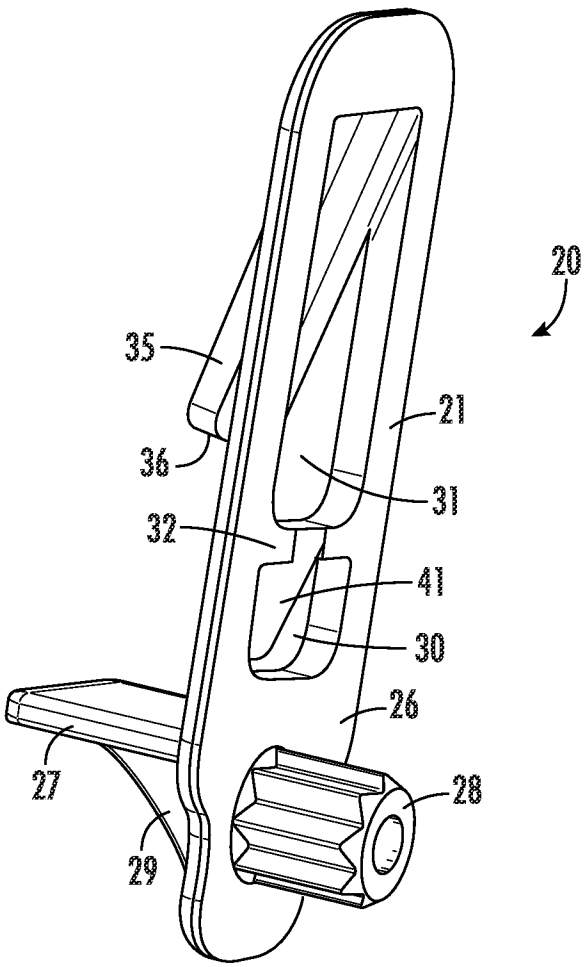
FIG. 1 is a rear perspective view of a shelf support according to embodiments of the invention.
Figure 5:
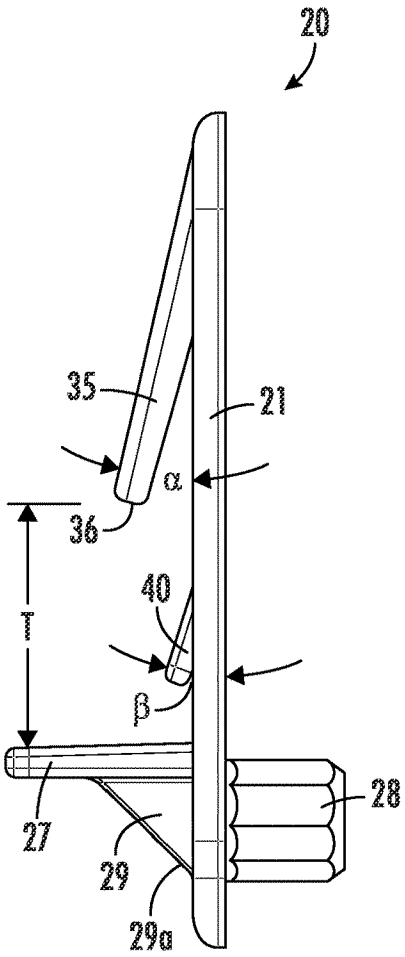
FIG. 5 is a side view of the shelf support of FIG. 1.
Figure 4:
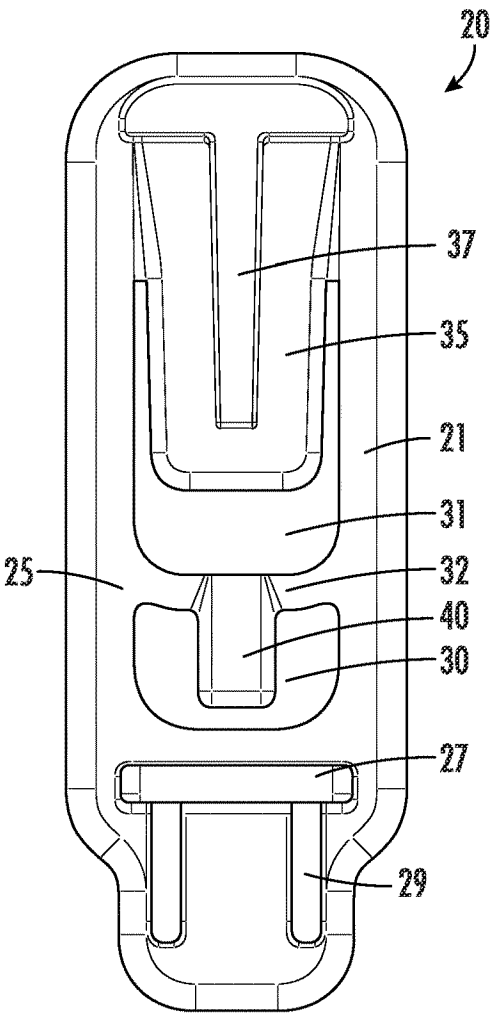
FIG. 4 is a front view of the shelf support of FIG. 1.
Figure 3:
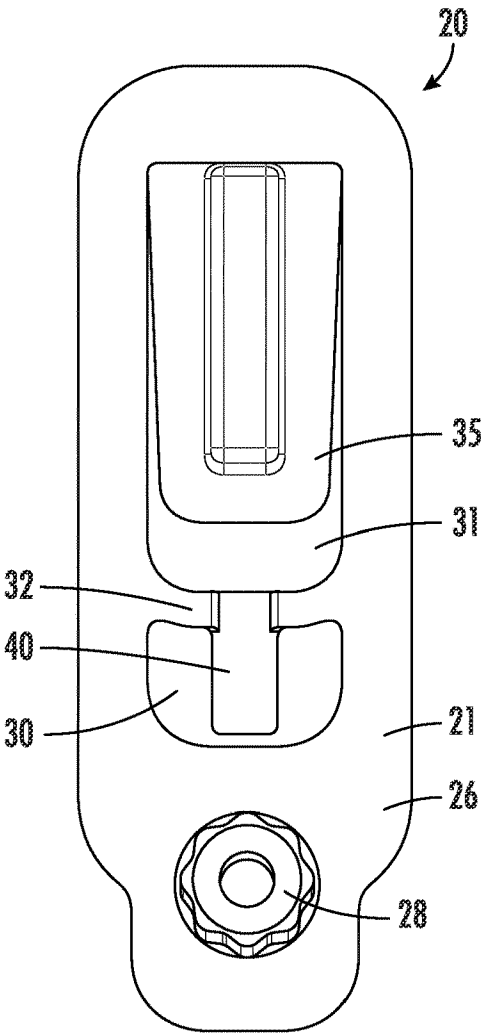
FIG. 3 is a rear view of the shelf support of FIG. 1.

The present disclosure will be described below with reference to the drawings, in which several embodiments of the present disclosure are shown. It should be understood, however, that the present disclosure may be presented in multiple different ways, and not limited to the embodiments described below. In fact the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that in all the drawings, the same reference signs present the same elements. In the drawings, for the sake of clarity, the sizes of certain features may be deformed.

It should be understood that the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any longer.

The singular forms "a/an", "said" and "the" as used in the specification unless clearly indicated, all contain the plural forms. The wordings "comprising", "containing" and "including" used in the specification indicate the presence of the claimed features, but do not repel the presence of one or more other features. The wording "and/or" as used in the specification includes any and all combinations of one or more of the relevant items listed. The phases "between X and Y" and "between about X and V" as used in the specification should be construed as including X and Y. The phrase "between about X and Y" as used in the present specification means "between about X and about Y", and the phrase "from about X to V" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element. By contrast, where one element is referred to as being "directly" on another element, "directly attached to" another element, "directly connected to" another element, "directly coupled to" another element, or "in direct contact with" another element, there will not be present with an intermediate element. In the specification, where one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwisely oriented (rotated 90 degrees or at other orientations). At this time, the relative spatial relations will be explained correspondingly.

The shelf support described herein may be employed in any type of furniture, including but not limited to book cases, cabinets (including china cabinets, curio cabinets, hutches, display cabinets, etc.) and the like. The furniture may be free-standing furniture, as well as installed, custom-made, or wall-mounted furniture such as kitchen cabinets, custom closet assemblies and wall units, etc.

The shelf support described herein may be conveniently formed as a single unitary or monolithic piece or part of a suitable resilient synthetic organic polymer material such as acrylonitrile butadiene styrene (ABS) or polycarbonate. The part may be formed by any suitable process, typically by injection molding. As used herein, "unitary" or "monolithic" means an object that is a single, unitary piece formed or composed of a material without joints or seams.

A shelf support according to embodiments of the invention is designated broadly at 20 and is illustrated in FIGS. 1-5. The shelf support 20 comprises a main body 21 that is substantially rectangular in shape and generally planar and has a front face 25 and a rear face 26. A shelf flange 27 is mounted to and extends from a lower location on the front face 25, and a dowel 28 is mounted to and extends from a lower location on the rear face 26. Two gussets 29 with slightly concave long edges 29*a* support the shelf flange 27 from underneath. The upper edges of the gussets 29 may extend between about 40 and 70 percent of the length of the flange 27. The dowel 28, which is inserted into a hole in the cabinet wall, may be fluted as shown, may be round, may be a "split dowel", or may take other shapes known to those of skill in this art.

The main body 21 has a lower opening 30 and an upper opening 31 that are divided by a cross-beam 32. A substantially flat capturing finger 35 is connected to the top edge portion of the upper opening 31. The capturing finger 35 extends forwardly and downwardly in front of the upper opening 31 at an oblique angle $\alpha$ to the main body 21 (typically the angle $\alpha$ is between about 10 and 20 degrees, with an angle $\alpha$ of between 13 and 17 degrees in some embodiments). The lower end 36 of the capturing finger 35 typically extends between about 0.1 and 0.3 inches in front of the front face 25 of the main body 21. The lower end 36 of the capturing finger 35 is spaced from the upper surface of the flange 27; the distance T that separates the lower end 36 and the flange 27 determines thickness (within a range) of a shelf that is mounted therebetween. As shown herein, the capturing finger 35 includes a rib 37 that extends over most of its length. The capturing finger 35 is dimensioned to be collapsibly received within the upper opening 31 when the capturing finger 35 deflects relative to the main body 21.

A centering finger 40 is mounted on and extends forwardly and downwardly away from the cross-beam 32 in front of the lower opening 30. A notch 41 is present in the cross-beam 32 rearwardly of the fixed end of the centering finger 40. The centering finger 40 extends at an oblique angle β relative to the main body 21 (typically the angle β is between about 10 and 20 degrees, with the angle β being between about 14 and 18 degrees in some embodiments). The lower end of the centering finger 40 extends between about 0.005 and 0.188 inches (typically about 0.05 and 0.1 inches) in front of the front face 25 of the main body 21.

Figure 7:
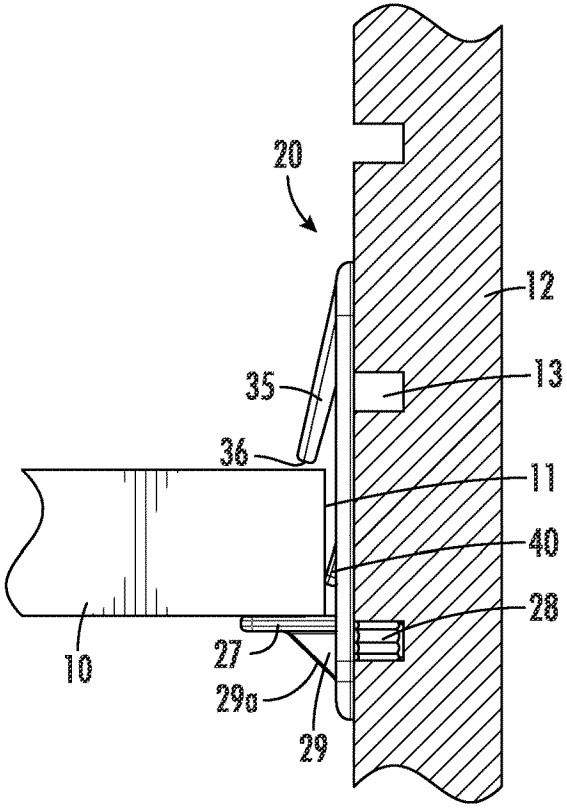
FIG. 7 is a side section view of a shelf support of FIG. 1 installed in a cabinet as in FIG. 6.
Figure 6:
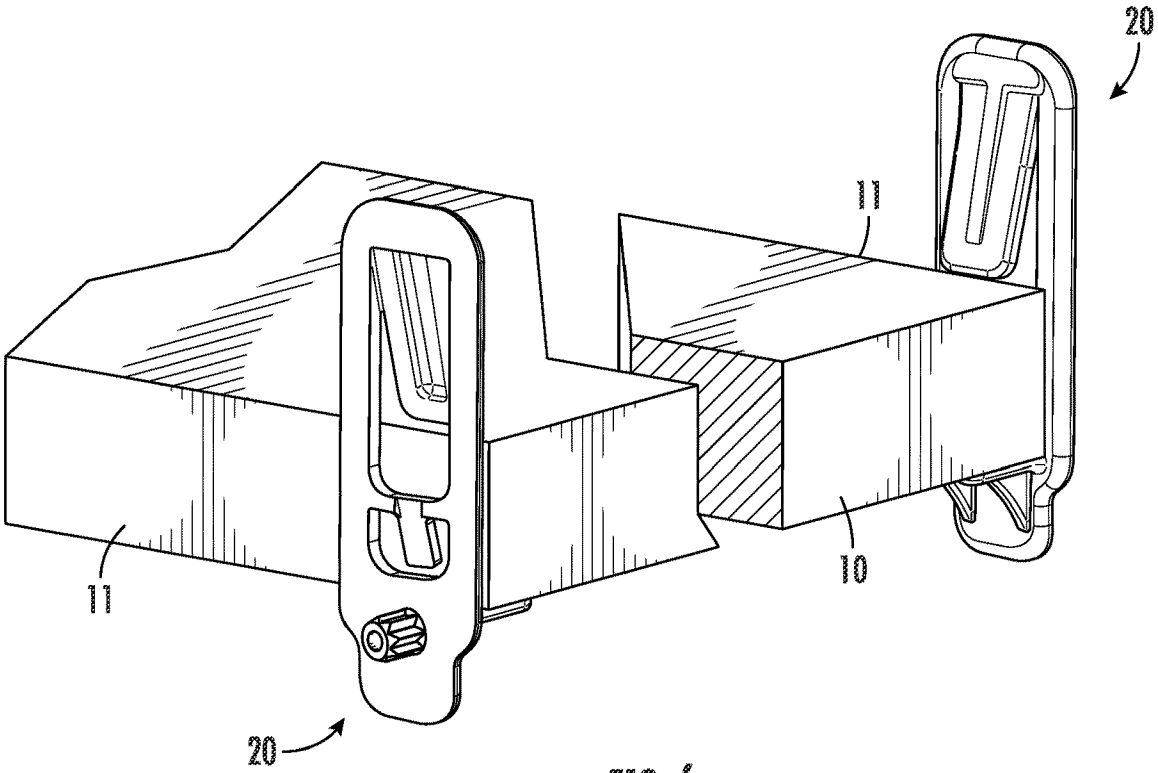
FIG. 6 is a perspective view of a cabinet or like structure that incorporates a pair of shelf supports of FIG. 1.

FIGS. 6 and 7 show a pair of shelf supports 20 supporting a shelf 10. As shown in FIG. 6, each shelf support 20 is positioned to support the edge portion 11 of the shelf 10 on one wall 12 of a pair of opposing walls in a cabinet or the like, as described above. The wall has at least one, and more typically a series, of holes or openings 13 formed therein to receive and hold the shelf support 20, as described below. In a typical embodiment, four shelf supports 20 would be used to support a shelf, with two such supports supporting opposite ends of each shelf edge portion.

During installation, shelf supports 20 (typically four two on each opposing wall of the cabinet) are mounted to the walk 12 of the cabinet by inserting each dowel 28 into a respective hole 13 in one of the cabinet walls 12. The shelf supports 20 are all mounted at the same elevation. A shelf 10 is then lowered onto the shelf supports 20, As the shelf 10 descends, the side edges 11 of the shelf 10 contact the forward surfaces of the capturing fingers 35, causing the capturing fingers 35 to deflect rearwardly toward (and in some instances into) the upper openings 31. Once the upper surface of the shelf 10 passes the lower end 36 of the capturing fingers 35, the deflected fingers 35 recover toward their original positions. The lower surface of the shelf 10 rests on the flanges 27. The lower end 36 of each capturing finger 35 is positioned above the shelf 10, either in engagement with the shelf 10 or just above it. Thus, the capturing fingers 35 can maintain the shelf 10 in position and prevent the shelf 10 from being dislodged via upward movement.

It should be noted that the presence of the rib 37 on the capturing finger 35 can assist in the installation of the shelf 10. More specifically, the rib 37 increases the stiffness of the capturing finger 35. As a result, when the shelf 10 contacts the capturing 35, not only is there some deflection of the capturing finger 35 relative to the main body 21, there is also deflection of the upper portion of the main body 21 away from the cabinet wall 12, which further causes the lower end 36 of the capturing finger 35 to travel toward the main body 21. These combined actions can make it easier to slide the shelf 10 past the lower end 36 of the capturing finger 35. However, once the shelf 10 clears the lower end 36 of the capturing finger 35 and the capturing finger 35 recovers to its original, relaxed position, the additional stiffness provided by the rib 37 can help to retain the shelf 10 in place.

Moreover, the presence and/or location of the concave edge 29*a* of the gussets 29 of the shelf support 20 can improve the ergonomics of installation of the shelf support 20 into (and removal from) a respective hole 13 in a cabinet wall 12, The concave shape of the long edges 29*a* can provide a relatively comfortable surface for the installer's fingers or thumbs to squeeze against, which can improve speed and consistency of installation and/or removal of the shelf support 20.

In addition, once the shelf 10 passes below the lower end of the capturing finger 35, it may contact the centering finger 40 with its side edge 11 and deflect the centering finger 40 toward the lower opening 30. As the centering finger 40 deflects, it exerts a force against the shelf 10 toward the opposite wall 12 of the cabinet. The forces exerted by the centering fingers 40 on opposite sides of the cabinet tend to force the shelf 10 into a centered position between the walls 12 of the cabinet.

While shelf supports of the present invention are intended to be used in pairs, and particularly two pairs for each shelf, it will be appreciated that a shelf support of the invention could be used on one side of a shelf and a different type of support could be used on the other side, particularly where sufficient locking is obtained with a single locking-type shelf support. It will also be appreciated the some, all, or none of the supports may include a side abutment portion, depending upon whether the cabinet has a solid back, front edge portions, or the like The foregoing is illustrative of the present invention and is not to be construed as limiting thereof. The invention is defined by the following claims, with equivalents of the claims to be included therein.

That which is claimed is:

1. A shelf support, comprising:

a generally planar main body with front and rear faces, the main body further having upper and lower openings with a cross-beam therebetween;

a support flange extending generally perpendicularly from the front face;

a mounting dowel extending generally perpendicularly from the rear face;

a capturing finger mounted at an upper edge of the upper opening, the capturing finger extending forwardly and downwardly at a first oblique angle to the front face; and a centering finger extending forwardly and downwardly from the cross-beam at a second oblique angle to the front face.

2. The shelf support defined in claim 1, wherein the first oblique angle is between about 10 and 20 degrees.

3. The shelf support defined in claim 1, wherein the second oblique angle is between about 10 and 20 degrees.

4. The shelf support defined in claim 1, formed of a polymeric material.

5. The shelf support defined in claim 1, wherein the shelf support is injection molded.

6. The shelf support defined in claim 1, wherein the centering finger has a lower end, and wherein the lower end is between about 0.005 and 0.188 inches from the front face.

7. The shelf support defined in claim 1, wherein the capturing finger includes a supporting rib extending along a length dimension of the capturing finger.

8. The shelf support defined in claim 1, further comprising a gusset fixed to the flange and the main body, and wherein the gusset has a concave long edge.

9. A shelf support, comprising:

a generally planar main body with front and rear faces, the main body further having upper and lower openings with a cross-beam therebetween;

a support flange extending generally perpendicularly from the front face;

a mounting dowel extending generally perpendicularly from the rear face;

a capturing finger mounted at an upper edge of the upper opening, the capturing finger extending forwardly and downwardly at a first oblique angle to the front face, the first oblique angle being between about 10 and 20 degrees; and a centering finger extending forwardly and downwardly from the cross-beam at a second oblique angle to the front face, the second oblique angle being between about 10 and 20 degrees.

10. The shelf support defined in claim 9, wherein the shelf support is injection molded.

11. The shelf support defined in claim 9, wherein the centering finger has a lower end, and wherein the lower end is between about 0.005 and 0.188 inches from the front face.

12. The shelf support defined in claim 9, wherein the capturing finger includes a supporting rib extending along a length dimension of the capturing finger.

13. The shelf support defined in claim 9, further comprising a gusset fixed to the flange and the main body, and wherein the gusset has a concave long edge.

14. A cabinet-shelf assembly, comprising:

a cabinet having two opposed side walls;

a generally horizontal shelf extending between the two side walls; and a shelf support mounted to each of the side walls to support the shelf, at least one of the shelf supports comprising:

a generally planar main body with front and rear faces, the main body further having upper and lower openings with a cross-beam therebetween;

a support flange extending generally perpendicularly from the front face and supporting the shelf;

a mounting dowel extending generally perpendicularly from the rear face and mounted in a hole in the side wall of the cabinet;

a capturing finger mounted at an upper edge of the upper opening, the capturing finger extending forwardly and downwardly at a first oblique angle to the front face, a lower end of the capturing finger engaging an upper surface of the shelf; and a centering finger extending forwardly and downwardly from the cross-beam at a second oblique angle to the front face, the centering finger engaging a side edge of the shelf.

15. The assembly defined in claim 14, wherein the first oblique angle is between about 10 and 20 degrees.

16. The assembly defined in claim 14, wherein the second oblique angle is between about 10 and 20 degrees.

17. The assembly defined in claim 14, formed of a polymeric material.

18. The assembly defined in claim 14, wherein the shelf support is injection molded.

19. The assembly defined in claim 14, wherein the centering finger has a lower end, and wherein the lower end is between about 0.005 and 0.188 inches from the front face.

20. The assembly defined in claim 14, wherein the capturing finger includes a supporting rib extending along a length dimension of the capturing finger.

21. The assembly defined in claim 14, further comprising a gusset fixed to the flange and the main body, and wherein the gusset has a concave long edge.

* * * * *